United States Patent [19]

Höfling et al.

[11] Patent Number: 4,645,059

[45] Date of Patent: Feb. 24, 1987

[54] ROLLER-PATH SYSTEM

[75] Inventors: Peter Höfling, Dortmund; Klaus Schöneweiss, Hattingen, both of Fed. Rep. of Germany

[73] Assignee: O&K Orenstein & Koppel Aktiengesellschaft, Berlin, Fed. Rep. of Germany

[21] Appl. No.: 659,473

[22] Filed: Oct. 10, 1984

[30] Foreign Application Priority Data

Oct. 15, 1983 [DE] Fed. Rep. of Germany ..... 3337611

[51] Int. Cl.[4] ..... B66B 9/00

[52] U.S. Cl. ..... 198/321; 198/838

[58] Field of Search ..... 198/321, 851, 853, 845, 198/838, 615

[56] References Cited

U.S. PATENT DOCUMENTS 3,530,799 9/1970 Braun ..... 198/321

FOREIGN PATENT DOCUMENTS 241348 7/1965 Austria ..... 198/851

2223823 3/1979 Fed. Rep. of Germany .

*Primary Examiner*—Joseph E. Valenza
*Assistant Examiner*—Kyle E. Shane
*Attorney, Agent, or Firm*—Martin A. Farber

[57] ABSTRACT

Roller-path system for the transportation of persons and goods, having an endless tread-plate band reversed around a horizontal axis as well as either a freely supported or a roller supported traction chain and self-supporting tread plates, each plate having two pull and two drag support-rod parts arranged close to the slate corners, respectively, opposite each other, where these plates can either directly support themselves, freely supporting rollers and the pull support-rod parts in addition to the traction chain, or can indirectly support themselves, having the pull support-rod parts mounted in traction chains with intermediate rollers and fork-shaped tread-plate resting elements which are attached by drag support-rod parts. The support-rod parts are provided as replaceably arranged system-adaptable pull and drag bolts.

16 Claims, 3 Drawing Figures

1
2a
2b
3a
3b
4
5
6
7
8
9
10

ROLLER-PATH SYSTEM

BACKGROUND OF THE INVENTION

The invention relates to a roller-path system for the transportation of persons and goods, having an endless tread-plate band reversed around a horizontal axis as well as either a freely supported or a roller-supported traction chain system and tread plates each having two pull and two drag support rod parts arranged close to the corners, opposite each other and according to the system to which applied, the tread-plates either directly supporting themselves, freely support rollers and the pull support rod parts in addition to the traction chain, or, indirectly supporting themselves, have the pull support bar parts mounted in traction chains with intermediate rollers and fork-shaped tread-plate resting elements which are fastened by drag support rod parts over which they grip.

In the roller paths customary up to the present time, two different systems have been used for the traction parts. In the first system, each tread plate rests directly on two continuous bars with a total of four rollers and, in addition, the traction chains are arranged on both sides of the tread plate and are freely supported by one of the bars, the so-called pull bar. In the second system, rollers are provided in each traction chain between the chain plates and the pull bars are mounted in the chain.

In one such embodiment, the bar ends could be both chain pins and, at the same time, roller shafts (Federal Republic of Germany AS No. 22 23 823).

The two different systems of the roller paths with respect to their traction elements which have been described above resulted also in two different embodiments of the tread-plates.

The object of the present invention is to create a single tread-plate which can be used universally for both systems.

SUMMARY OF THE INVENTION

In accordance with the present invention, a roller-path system of the above-mentioned type includes a single tread-plate which is employed regardless of which of the above two systems is being used, where the support rod parts are provided as replaceably arranged system-adaptable pull and drag bolts.

The per se known tread-plate load-transmission elements, such as the drag and pull rollers or the forked resting elements, are arranged, adapted to either respective system, between the tread-plate side walls and the inside plates of the traction-chain. In particular, the transmission elements are aligned with each other parallel to the direction of travel of the tread-plate band between the tread-plate side walls and the traction-chain inside plates.

In the second system adaptation, the pull bolts which represent the chain pins have an inter-tine support for a double-tined fork-shaped resting element, the support being provided on each pull bolt between tread-plate side wall and the traction-chain inside plates. Furthermore, the shank of the resting element is fastened to the tread-plate side wall by a drag bolt. An additional securing of the resting element to the tread-plate side wall is effected by a counterbolt which engages into the shank of the resting element. In operation of an endless tread-plate band in this system, the two tines of the fork-shaped resting element of one tread-plate are coupled to, engaging around the inter-tine support of the next pull bolt of the adjacent tread-plate.

Turning now to the tread-plate adapted for the first system, there are provided drag bolts and also pull bolts representing chain pins. The pull bolts have pull rollers and the drag bolts have drag rollers.

In accordance with the invention, the tread-plate advantageously consists of a single piece casting which is adaptable to use in either of the above two systems.

BRIEF DESCRIPTION OF THE DRAWINGS

One diagrammatic embodiment of the invention will now be explained with reference to the drawing, in which.

DETAILED DESCRIPTION OF THE PREFERRED EMBODIMENT

Figures 1, 2, 3:
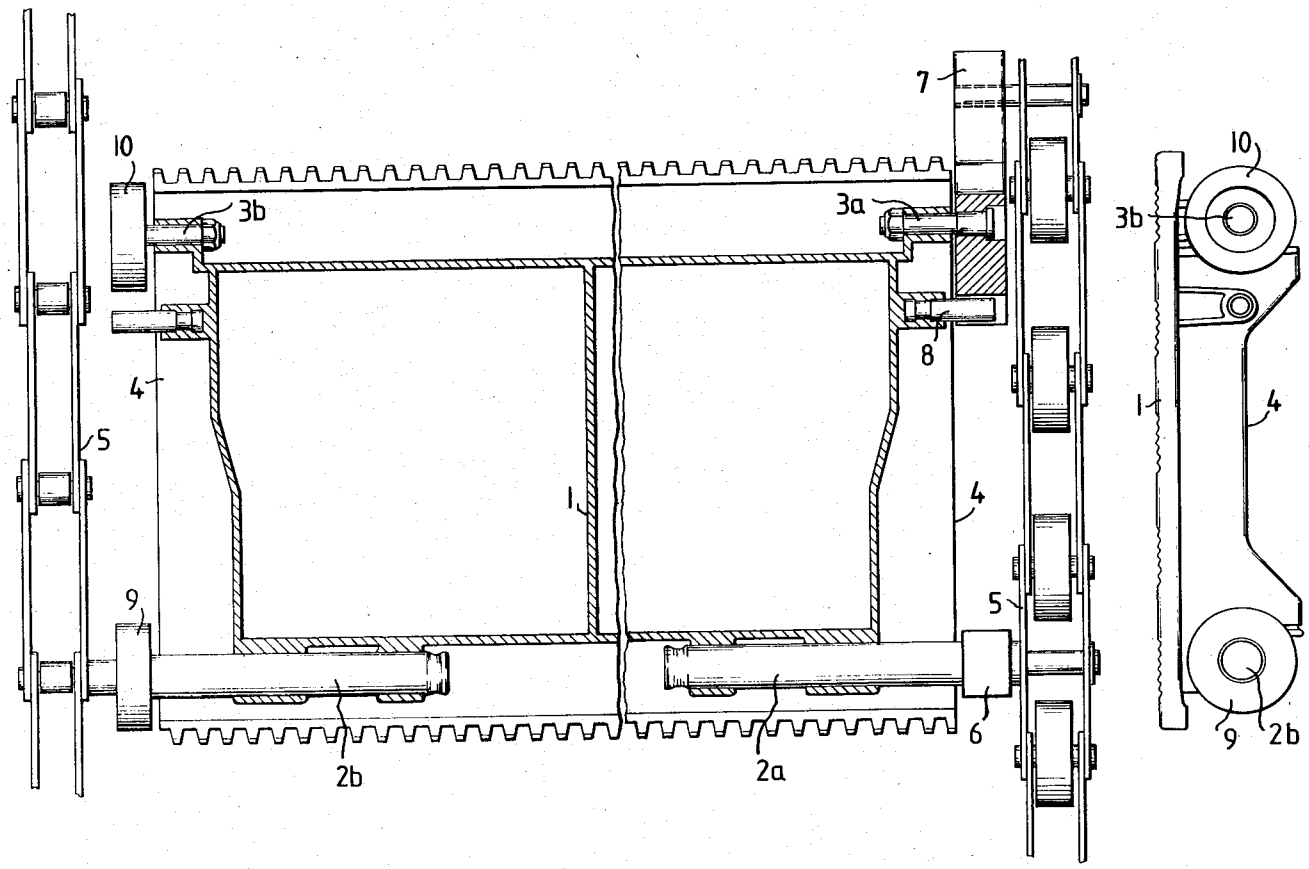
FIG. 1 is a partial, bottom view of the tread plate, seen in cross section, where the left-hand side of the drawing represents an adaptation for use in the first system and the right-hand side of the drawing represents an adaptation for use in the second system.
FIG. 2 is a side view of the right-hand of FIG. 1
FIG. 3 is a side view of the left-hand of FIG. 1.

FIG. 1 shows a tread-plate 1 which comprises a casting produced in a single piece. In FIG. 1 each of the left and right-hand portions of the tread-plate 1, is provided with a system of traction elements. Thus the universal applicability of the tread-plate 1 is shown. The indirectly supported tread-plate 1 in the right-hand half of FIG. 1 shows the pull and drag bolts 2*a* and 3*a* respectively, adapted to the above said second system. The pull bolt 2*a* is provided between the tread-plate side wall 4 and the traction-chain inside plate 5 with an inter-tine support 6. The shank of a two-tine fork-shaped resting element 7 is pivotally attached to the tread-plate side wall 4 by the drag bolt 3*a* and, in addition, by the counterbolt 8. It can be noted from FIGS. 1 and 2 that the two tines of each fork-shaped resting element 7 of a tread-plate are to be coupled engaging around the inter-tine support 6 of the next pull bolt of the next tread-plate. The traction chain, known per se, in which the pull bolt 2*a* rests, as well as its chain rollers has been shown merely to make matters clear and requires no further explanation.

By the mounting of suitable pull bolts 2*b* and drag bolts 3*b* the same tread-plate 1 can be adapted to the other (first) system, as represented by the left-side of FIG. 1, with traction elements in which the pull bolts 2*b* directly supports the tread-plate on pull roller 9 and the drag bolt 3*b* supports it on drag roller 10. In that case the traction chain, which is not shown in further detail, is freely borne by the pull bolts 2*b* of adjacent tread plates and, comparable to the arrangement of the fork-shaped tread-plate resting element 7, the tread-plate rollers, i.e., pull rollers 9 and drag rollers 10, are arranged between the tread-plate side wall 4 and the traction-chain inside plates 5.

FIG. 3 is a side view of the left-hand system of FIG. 1. The pull rollers 9 and drag rollers 10 can be clearly noted. It will also be noted in the respective systems that the tread-plate load-transmission elements, such as the tread-plate rollers (pull roller 9 and drag roller 10) of the first system or the fork-shaped tread-plate resting element 7 and tine support 6 of the second system, are arranged, respectively, aligned with each other parallel to the direction of the tread-plate band.

We claim:

1. In two separate, independent roller-path systems for the transportation of persons and goods, each system having an endless band reversed around a horizontal axis including traction-chains and tread-plates, each of said tread-plates having two pull and two drag bolts disposed close to corners of the tread-plates opposite each other, said traction-chains being freely supported in a first of the systems and being supported by rollers therebetween in a second of the systems, said tread-plates in said first system being directly freely supported, via freely supporting tread-plate rollers and the pull bolts in addition to the traction-chains of the first system, said tread-plates in said second system being indirectly supported, having the pull bolts mounted in the traction-chains of the second system and fork-shaped tread-plate resting elements attached by the drag bolts over which they grip, the improvement in said tread-plates wherein said tread-plates exclusive of said bolts are the same in said first and second systems, respectively, each of said tread-plates is connectable universally to both of said first and second systems, respectively, each of said tread-plates has side walls, the traction-chains having inside plates laterally adjacent said side walls and having outside plates, said pull and drag bolts are replaceably mountable in said tread-plates and are adaptable respectively to either said first or second system, and said tread-plate rollers of said first system and said fork-shaped tread-plate resting elements of said second system of all said tread-plates are respectively aligned with each other parallel to the direction of travel of the tread-plates arranged between said side walls of said tread-plates and said inside plates of respective of said traction-chains.

2. The roller-path system according to claim 1, wherein said pull bolts include pins of said traction-chains, an inter-tine support for each said pull bolt of said second system, each said support accommodating a respective of said fork-shaped tread-plate resting element.

3. The roller-path system according to claim 2, wherein said inter-tine supports are mounted on said pull bolts of said second system between the tread-plate side walls and the traction-chain inside plates.

4. The roller-path system according to claim 1, wherein each said fork-shaped tread-plate resting element comprises a two-tine element having a shank, said drag bolts attach said shanks to respective of said tread-plate side walls.

5. The roller-path system according to claim 4, further comprising counter bolts, wherein a respective of said tread-plate resting element is additionally secured to the respective of said tread-plate side walls by a respective of said counter bolts which engages in the shank of said tread-plate resting element.

6. The roller-path system according to claim 2, wherein each said tread-plate resting element has two tines, wherein said tines are coupled with and engage over a respective inter-tine support of the next pull bolt of the adjacent tread-plate.

7. The roller-path system according to claim 1, wherein said pull bolts include pins of said traction-chains, and wherein in the first system said tread-plate rollers are mounted on the pull bolts and the drag bolts.

8. The roller-path system according to claim 1, wherein each of the tread-plates exclusive of said support rod parts is a single piece casting.

9. The roller-path system according to claim 4, wherein each said resting element has two tines, wherein said tines are coupled with and engage over a respective inter-tine support of the next pull bolt of the adjacent tread-plate.

an inter-tine support for each said pull bolt of said second system, each said support accommodating a respective of said fork-shaped tread-plate resting element.

10. An apparatus including tread-plates for use in either of two separate, independent roller-path systems for the transportation of persons and goods, each system having an endless band reversed around a horizontal axis including traction-chains and a plurality of said tread-plates forming a continuous tread-plate band, wherein said tread-plates are identical and are connectable universally into both of said two separate, independent roller-path systems, respectively, each of said tread-plates has side walls, the traction-chains having inside plates laterally adjacent said side walls and having outside plates, said side walls are formed with recesses, said traction-chains of a first of the systems being freely supported in said first system and said traction-chains of a second of the systems being supported by rollers between said inside and outside plates in said second system, respectively, a set comprising first pull bolts and first drag bolts adapted for said first system and releasably connectable with said tread-plates via said recesses in said side walls thereof, and said first pull bolts being releasably connectable with said traction-chains of said first system, rollers means mounted on said bolts supporting said tread-plates via said bolts, and said roller means of said pull bolts for freely supporting said traction-chains of said first system via said first pull bolts, another set comprising second pull bolts and second drag bolts operatively releasably connectable in said recesses with said tread-plates and adapted for said second system, said second pull bolts being mounted in said traction-chains of said second system, fork-shaped elements, said second drag bolts comprising means for releasably connecting said fork-shaped elements to a corresponding of said tread-plates, said fork-shaped elements spanning in a direction of travel of said continuous tread-plate band said corresponding tread-plates and said tread-plates most adjacent to said corresponding tread-plates of said continuous tread-plate band and operatively connected about adjacent-most of said second pull bolts on said most adjacent tread-plates, said roller means and said fork-shaped elements for all said tread-plates are respectively aligned with each other parallel to the direction of travel of the tread-plates arranged between said side walls of said tread-plates and said inside plates of respective of said traction-chains laterally of said walls of said tread-plates, and only one of said sets of pull and drag bolts being connectable at a time to said tread-plates in said recesses and operatively to respective of said traction-chains of said first and systems, respectively.

11. A tread-plate usable with a plurality of the tread-plate forming an endless band defining a longitudinal direction, the tread-plate having a first longitudinal end and a second longitudinal end, a single tread-plate capable of being connected universally to both of two systems, respectively, in one of said systems said tread-plate adjacent both of said longitudinal ends being supported by chains and in the other of said systems rollers connectable adjacent to said ends of said plate supporting said plate, said other system having chains for said tread-plate, said tread-plate having mounting means adjacent each longitudinal end at both lateral sides of said plate, first of said mounting means on both said lateral sides of said plate adjacent said first longitudinal end are identical and second of said mounting means on said both lateral sides of said plate adjacent said second longitudinal end of said tread-plate are identical, said first mounting means receive connecting means which pivotably connect said plate to the chains in both of said systems, respectively, and said second mounting means are connectable via connecting means to only said rollers of said other system on each of said lateral sides of the plate respectively so that said second longitudinal end of said plate is free from the chains of said other system or respectively said second mounting means are connected to said chains of said one system via relatively slidable and pivotable connecting means.

12. The system as set forth in claim 11, wherein said connection means are pins.

13. The system as set forth in claim 11, wherein said chains of said one system are roller chains.

14. The system as set forth in claim 11, wherein said second mounting means includes two mounts on each said lateral side, both of said mounts being connectable to said relatively slidable and pivotal connecting means in said one system, and respectively one of said mounts not being used in said other system.

15. The system as set forth in claim 11, wherein in said one system said first-mentioned connecting means each includes an inter-tine support which is pivotal with respect to said first mounting means, and said relatively slidable pivotal connecting means each has a fork slidably engaging said inter-tine support of an adjacent of said tread-plates.

16. The system as set forth in claim 11, wherein in said one system said relatively slidable pivotal connecting means slidably and pivotally engage said first-mentioned connecting means of an adjacent of said tread-plates.

* * * * *